US007377085B2

(12) United States Patent
Cirio

(10) Patent No.: US 7,377,085 B2
(45) Date of Patent: May 27, 2008

(54) DEVICE FOR APPLYING A CAP ON THE NECK OF A BOTTLE OR SIMILAR CONTAINER, GRIPPING ASSEMBLY FORMING PART OF THIS DEVICE, AND METHOD TO BE PERFORMED BY THIS DEVICE

(75) Inventor: Sergio Cirio, Canelli (IT)

(73) Assignee: Arol SpA, Canelli (Asti) (IT)

( * ) Notice: Subject to any disclaimer, the term of this patent is extended or adjusted under 35 U.S.C. 154(b) by 109 days.

(21) Appl. No.: 10/879,735

(22) Filed: Jun. 30, 2004

(65) Prior Publication Data

US 2005/0183388 A1 Aug. 25, 2005

(30) Foreign Application Priority Data

Feb. 20, 2004 (EP) ..... 04425106

(51) Int. Cl.
*B26D 7/06* (2006.01)
*B65B 7/28* (2006.01)

(52) U.S. Cl. ..... 53/317; 53/284.5

(58) Field of Classification Search ..... 53/420, 53/471, 485, 490, 276, 284.5–284.6, 295, 53/317, 54, 58, 68; 83/123, 125, 145
See application file for complete search history.

(56) References Cited

U.S. PATENT DOCUMENTS 4,614,073 A * 9/1986 Argazzi ..... 53/54
4,934,230 A * 6/1990 Wallis ..... 83/128
4,942,718 A * 7/1990 Courtois et al. ..... 53/435
5,115,617 A * 5/1992 Lewis et al. ..... 53/306
5,157,897 A * 10/1992 McKee et al. ..... 53/308
5,220,767 A 6/1993 de Santana
5,313,765 A * 5/1994 Martin ..... 53/317
5,457,936 A * 10/1995 Neel ..... 53/317
6,026,175 A * 2/2000 Munro et al. ..... 382/135
6,044,626 A * 4/2000 Harper et al. ..... 53/490
6,158,196 A * 12/2000 Trebbi et al. ..... 53/331.5

FOREIGN PATENT DOCUMENTS

DE 195 05 883 A1 6/1996
EP 1 103 513 A1 5/2001

* cited by examiner

*Primary Examiner*—Louis K. Huynh
*Assistant Examiner*—John Paradiso
(74) *Attorney, Agent, or Firm*—Sughrue Mion, PLLC

(57) ABSTRACT

A device for applying a cap on the neck of a bottle or similar container comprises an applying head movable along an axis and provided with an assembly for gripping the cap having a tubular body with an end mouth which is adapted to receive and hold within it the cap. Inside said tubular body is mounted freely slidable an ejector member. Stop means are provided to limit the upwards displacement of the ejector member with respect to a fixed reference when the applying head moves upwards subsequent to an application of a cap.

8 Claims, 5 Drawing Sheets

DEVICE FOR APPLYING A CAP ON THE NECK OF A BOTTLE OR SIMILAR CONTAINER, GRIPPING ASSEMBLY FORMING PART OF THIS DEVICE, AND METHOD TO BE PERFORMED BY THIS DEVICE

BACKGROUND OF THE INVENTION

The present invention relates to devices for applying a stopper or cap on the neck of a bottle or similar container, of the type comprising an applying head movable along an axis and provided with an assembly for gripping the cap having a tubular body with an end mouth for receiving and holding the cap, and wherein is slidably mounted an ejector member inside said tubular body along said axis.

A device of the type specified above is disclosed, for instance, in European patent application EP 1 103 513 A1, which refers to a screwing device in which the applying head is provided both with an axial movement, and with a rotary movement for screwing a cap onto the threaded neck of a bottle. In known devices of this kind, an ejector member is provided to eject the cap from the gripping assembly if, for any reason, the operation of applying the cap is not performed and the cap remains caught within the gripping assembly.

A high production rate machine for applying caps on bottles typically has a general carrousel configuration, with a plurality of applying heads which operate moving in synchronism along the carrousel together with the supports for the bottles. While each applying head and the corresponding bottle positioned below it move along the carrousel, the applying head previously loaded with a cap moves downwards and rotates, screwing the cap on the neck of the bottle, then returns to a raised position. Obviously, if the screwing operation is not performed, for example because the bottle is missing, or because of a misaligned positioning of the cap in the gripping assembly of the head, the cap remains in the gripping assembly also during the final phase of re-raising of the head, so it must be eliminated before the head, as the rotation of the carrousel continues, reaches the position where a new cap is picked up to perform a new cycle on a new bottle.

In prior art devices, the ejector member is constituted by a stem element which is mounted axially slidable through the head and which is controlled in its axial position by a respective actuating transmission. For example, in the case of conventional machines, both the axial motion of the head and the axial motion of the ejector stem are obtained by using cam-following rollers, borne by said elements, which roll on cam tracks during the rotation of the carrousel. The provision of an ejector member according to the prior art described above therefore entails a construction complication and it is a source of drawbacks from the standpoint of the compatibility of the machine with the regulations on cleanliness and health to be enforced in the case of certain types of bottles and containers, in relation to their content. The provision of an ejector member slidably guided through the applying head is not advantageous from this point of view, because the ejector member continually moves between the lower area of the head, which must be kept clean and aseptic, and the upper area, which is kept isolated by the lower part because it includes the various actuation mechanisms of the machine and the related lubrication system.

SUMMARY OF THE INVENTION

The main object of the present invention therefore is to provide a device of the type set out at the start of the present description which is capable of overcoming the aforementioned drawbacks.

An additional object of the invention is to provide a device of the type set out above, in which the ejector member is characterised by an extremely simple, low cost structure.

Yet a further object of the invention is to provide a device of the type set out above, in which the ejector member does not require an additional constructive complication of the machine in relation to the need to control its axial position.

Lastly, an object of the invention is to reach the above objects whilst assuring the cleanliness of the environment where the cap is applied on the bottle.

These and other objects and advantages of the invention are achieved by means of a device having the characteristics set out at the start of the present description and further characterised in that the aforesaid ejector member is mounted freely slidable within the tubular body of the gripping assembly and in that stop means are provided to limit the upwards displacement of said ejector member relative to a fixed reference when the applying head moves upwards after a cap application phase.

Thanks to the aforesaid characteristic, the structure of the ejector member can be extremely simplified. Moreover, since the ejector member is mounded freely slidable within the gripping assembly, it is not necessary to provide and system for the positive control of the axial position of the ejector member, with a consequent further simplification relative to prior art machines.

With the device according to the invention, if during a rotation of the carrousel the cap borne by the applying head is not applied to a respective bottle, so that the applying head is raised again with the cap still caught within the gripping assembly, the ejector member ejects the cap without any positive command being required on the ejector member. During the re-raising of the head, after the ejector member comes in contact with the aforesaid stop means it is no longer able to follow the head in its rising movement. Therefore, the additional rising of the head causes a relative displacement of the ejector member in the direction of the head gripping mouth, with the consequent ejection of the cap.

The aforesaid stop means can be constituted by any fixed stop surface able to come in contact with any part or element rigidly connected to the ejector member. For example, in a preferred embodiment, the ejector member is constituted by a cylindrical body slidably mounted in the tubular body of the gripping assembly and said cylindrical body is rigidly connected to a ring mounted slidably outside the tubular body of the gripping assembly, through a diametrical pin which engages longitudinal slits obtained in the wall of the tubular body of the gripping assembly. The aforesaid ring which is slidably mounted outside the tubular body of the gripping assembly, and which is rigidly connected to the ejector member, comes in contact with the aforesaid stop surface determining the arrest of the ejector member during the head raising phase, with the consequent relative approach of the ejector member to the grip mouth.

Naturally, the conformation of the ejector member, the conformation of the stop means, and the conformation of the part connected to the ejector member destined to co-operate with the stop surface can also be wholly different from the example mentioned herein.

BRIEF DESCRIPTION OF THE DRAWINGS

Additional characteristics and advantages of the present invention shall become readily apparent from the description that follows with reference to the accompanying drawings, provided purely by way of explanatory and non limiting example, in which.

DETAILED DESCRIPTION OF THE INVENTION

Figure 1:
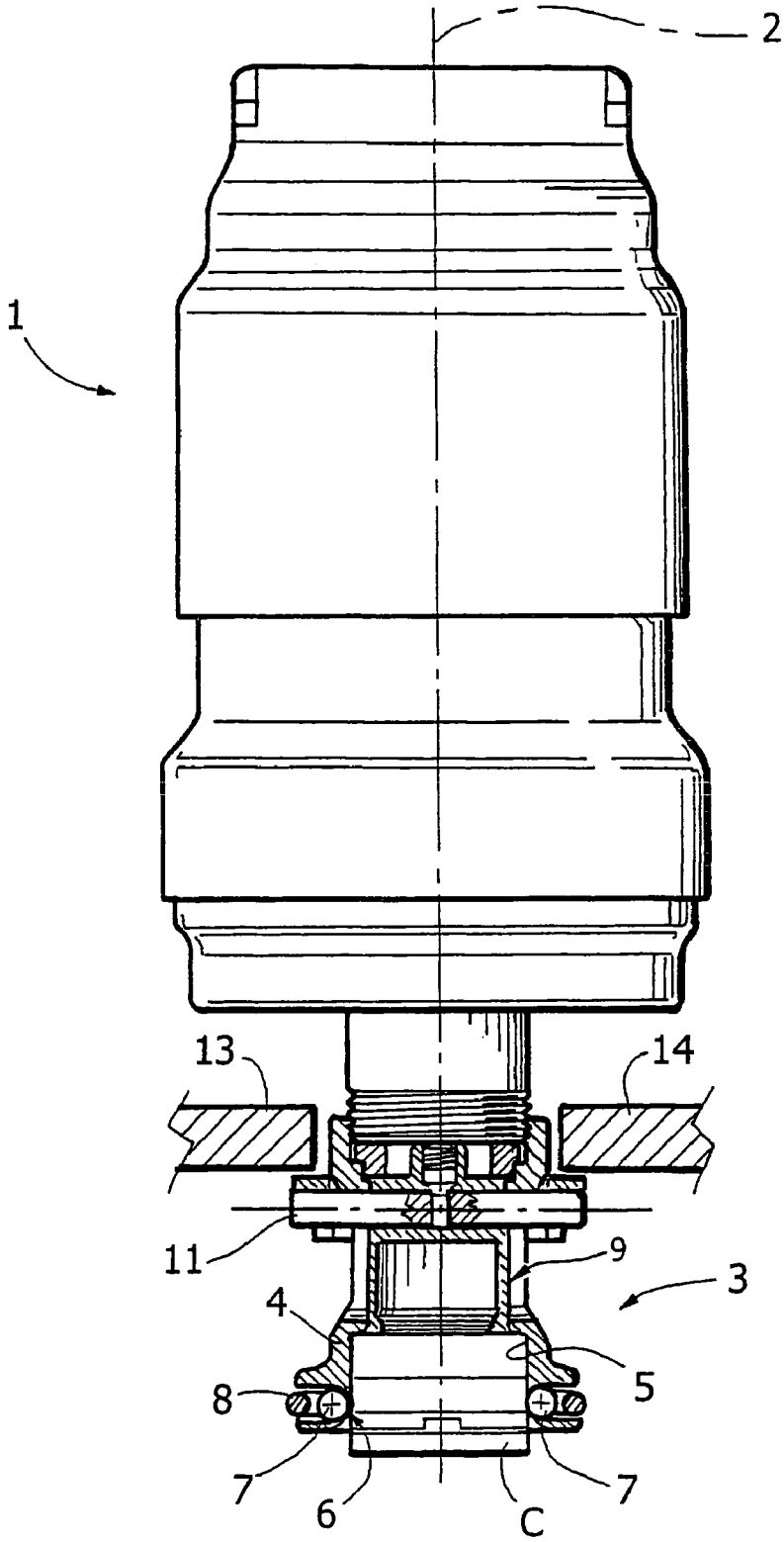
FIG. 1 is a schematic elevation view of an applying head according to the present invention, in a first operating phase.

In FIG. 1, the reference number 1 globally designates a screwing head, for screwing plastic caps of the type designated by the reference C on the threaded neck of bottles.

The accompanying drawings show only the screwing head and in detail the assembly for gripping the cap C borne by the head 1. Not shown, instead, is the structure of the machine whereon the head 1 is mounted, which can be obtained in any known manner. As mentioned above, machines of this kind typically have a carrousel structure with a plurality of screwing heads which move circumferentially along the carrousel in synchronism with respective supports for the bottles. At each revolution of the carrousel, each screwing head moves axially and rotates to screw a cap on a respective bottle. During each operating cycle, according to the prior art, each screwing head picks up a respective cap from a cap loader, which drops rotating over the neck of a respective bottle to screw the cap and then rises to a top dead centre position where it is again ready to pick up a new cap.

Figure 3:
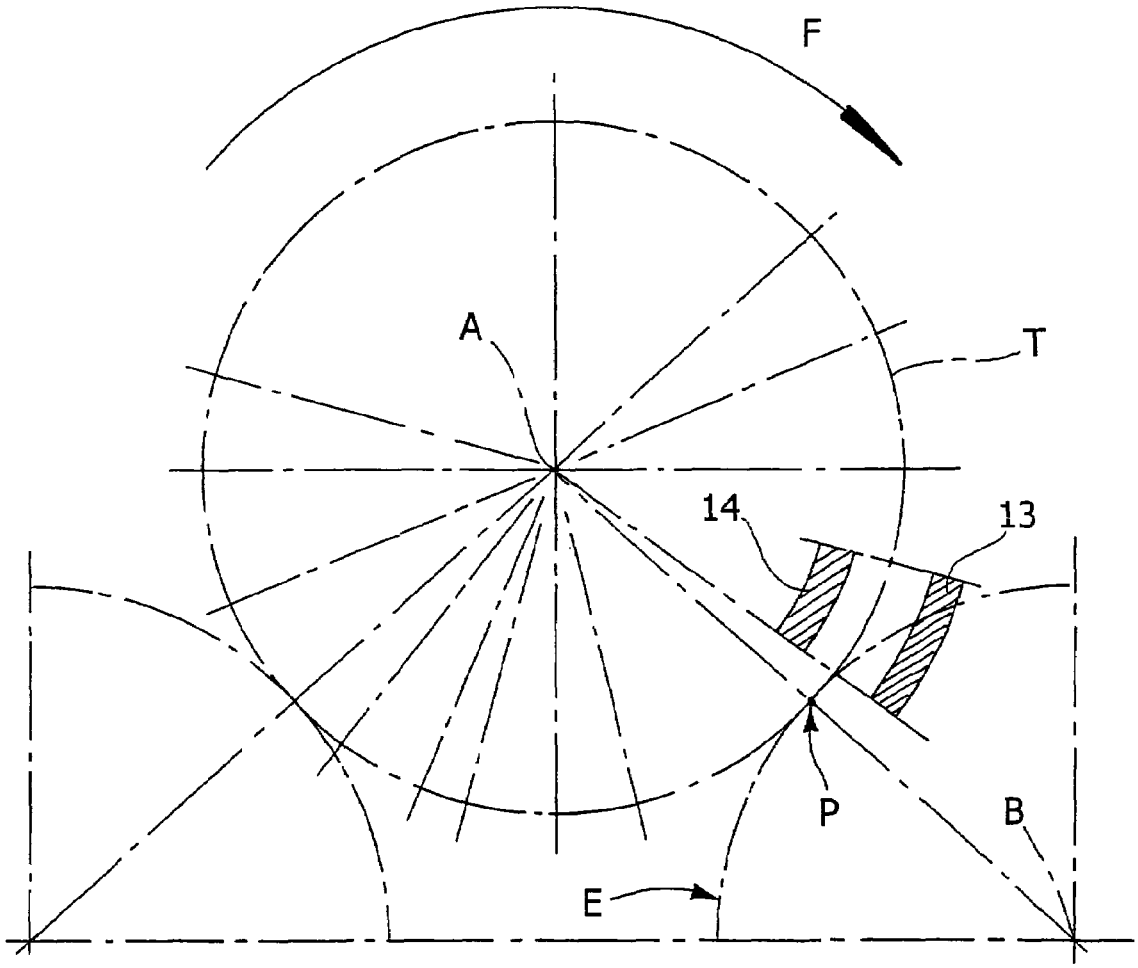
FIG. 3 is a schematic diagram showing the configuration of a machine using the device according to the invention, seen in plan view.

FIG. 3 of the accompanying drawings schematically shows a plan view of the circumferential trajectory T travelled by each screwing head 1 in its movement around the central axis A of the carrousel. In the illustrated example, the movement of the carrousel is clockwise, as shown by the arrow F. The reference P designates the area where each screwing head is at its top dead centre and is thus able to pick up a cap which moves circumferentially along a trajectory E, borne, also in accordance with the prior art, by a cap loader disk, which rotates around an axis B parallel to the axis A. The cycle of application of a cap on a bottle starts with the pick up in proximity to P of a new capsule by the screwing head and is performed whilst the latter moves along the circumferential trajectory T.

In accordance with the prior art are also obtained the means for actuating the movement of the screwing head 1 along its axis 2 (FIG. 1), as well as the rotation of the screwing head 1 around the axis 2. Such Means can be obtained in any known fashion and in themselves they are outside the scope of the present invention. For this reason, said constructive detail have been omitted from the accompanying drawings, also to make them more readily and easily understandable.

The screwing head 1 bears at its lower end a gripping head 3, more clearly visible in FIGS. 2-5. According to a characteristic known in itself, the gripping assembly 3 comprises a body 4 with tubular conformation which defines within it a seat 5 for gripping the cap C. For this purpose, the body 4 has a mouth 6 provided with means able elastically to hold the cap C. In the illustrated example, according to a known technique, said means comprise a plurality of balls 7 and one or more elastic rings 8 which surround them circumferentially. The balls 7 project through openings of the inner surface of the seat 5 in such a way as to be pressed against the lateral wall of the cap C by the elastic rings 8. When the screwing head 1 is lowered on a cap C carried by the loader disk to pick it up, the cap C enters the seat 5 overcoming the action of the elastic rings 8 and is held within said seat by effect of the elastic reaction of the rings 8, which thrust the balls 7 against the lateral wall of the cap C.

During the screwing of the cap, the screwing head 1 is lowered along the axis 2 in the direction of the neck of the bottle positioned below it, and it simultaneously rotates to screw the cap on the neck of the bottle. Once the screwing operation is completed, the head 1 is raised again, whilst the cap C, being screwed on the bottle, remains integral with the bottle and thus exits the seat 5 of the gripping assembly 3, overcoming the action of the elastic rings 8.

As illustrated above, it may occur that the cap screwing operation is not completed successfully, for instance if the bottle is missing below the screwing head or for any other reason, for example because of a misaligned positioning of the cap within the gripping assembly 3. In this case, it is obviously necessary to eject the cap C that has not been used by the gripping member before the latter must pick up a new cap for a new cycle.

For this purpose, inside the tubular body 4 of the gripping member 3 is slidably mounted an ejector member 9 that in the illustrated example has a cup-shaped cylindrical body. In prior art solutions, the ejector member is constituted by a rod sliding through the screwing head 1 which is positively actuated by means of actuation means, for example of the cam type, in order positively to control its position in the axial sense in each phase of the operation of the machine.

In the present invention, instead, the ejector member 9 is free and not subject to any command over its position.

Figure 5:
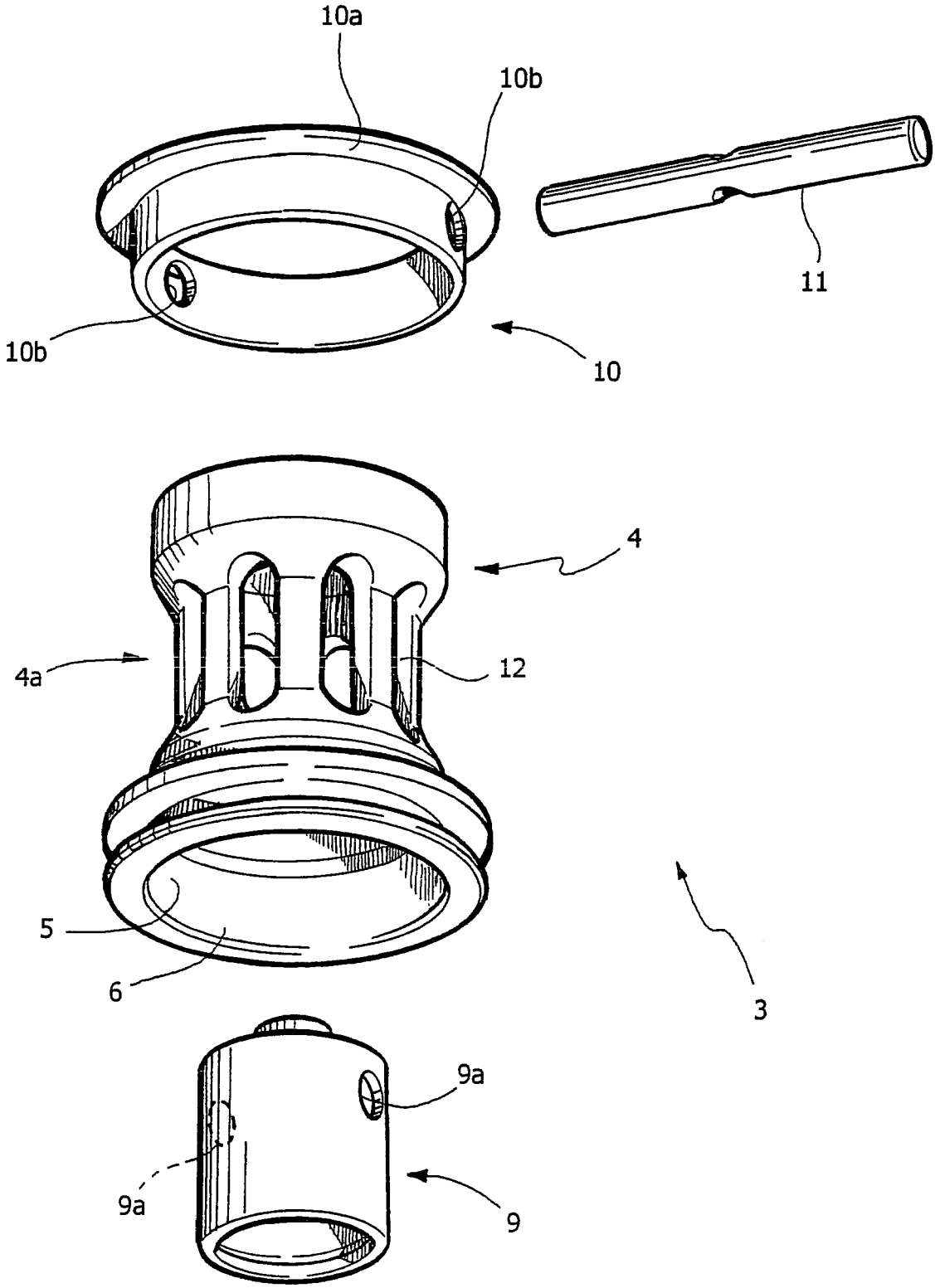
FIG. 5 is an exploded perspective bottom view of the assembly of FIG. 4.

With reference to the preferred embodiment illustrated herein, to the ejector member 9 is rigidly connected a ring 10 which is slidably mounted outside the tubular body 4, over an intermediate portion with reduced diameter, designated by the reference number **4*a* in FIG. 5. The external ring 10 is rigidly connected to the internal ejector member 9 by means of a diameter pin 11 which engages a pair of longitudinal slits 12 obtained in the intermediate portion 4*a* of the tubular body 4 and which are part of a plurality of slits 12, serving a lightening function as well, obtained in said body 4**.

Figure 2:
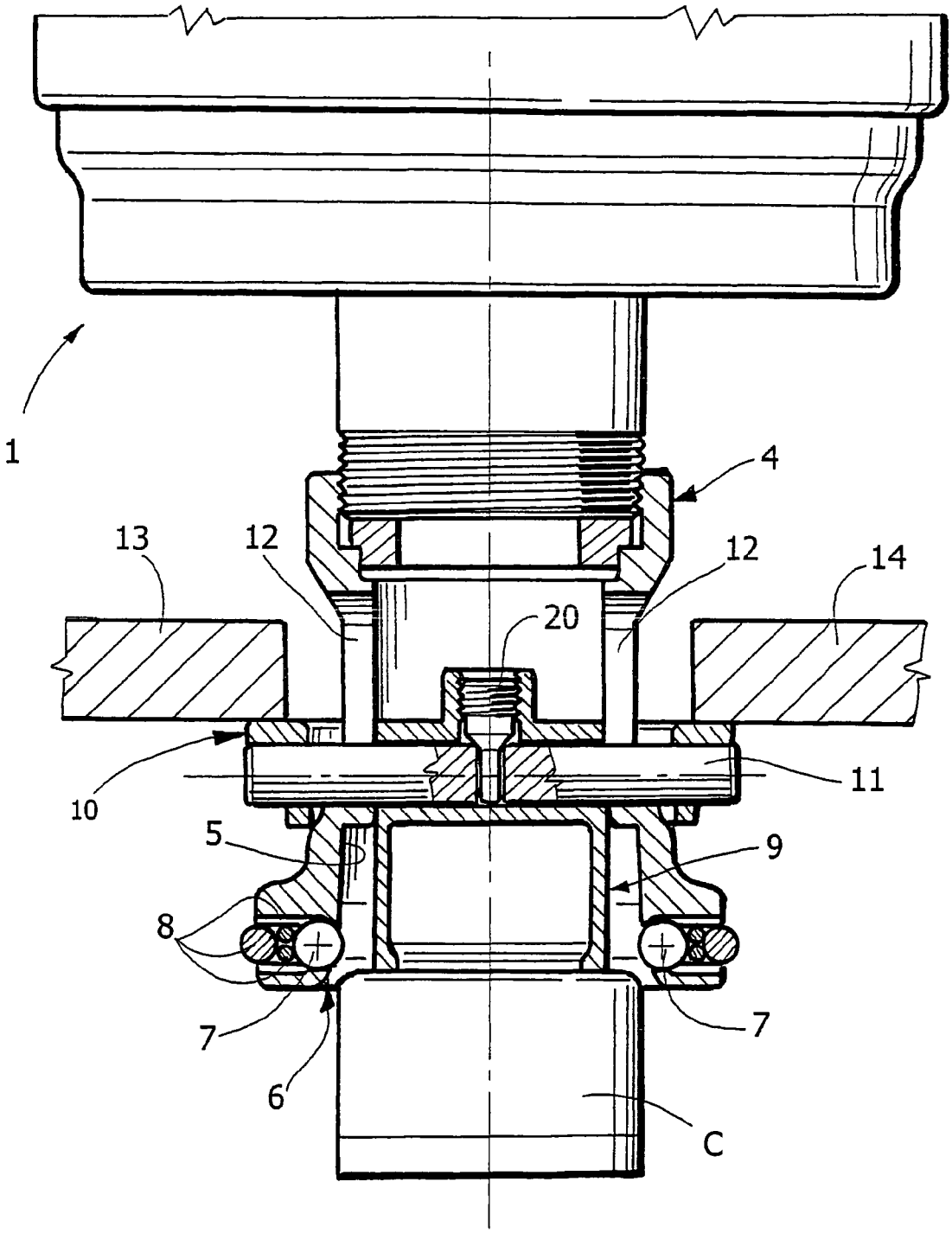
FIG. 2 is a view in enlarged scale of a detail of the head of FIG. 1, in a second operating phase.
Figure 4:
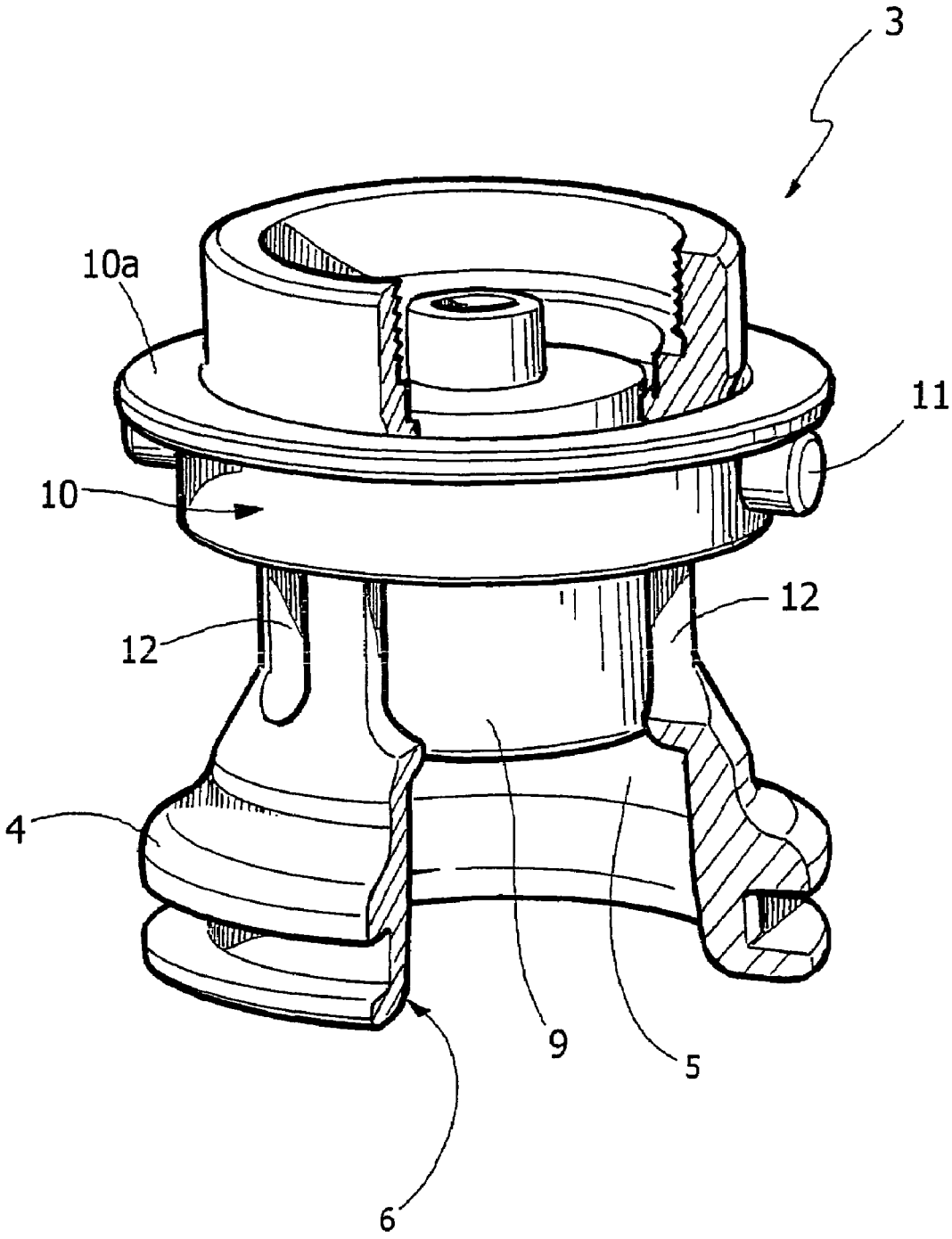
FIG. 4 is a partially sectioned schematic view of the gripping assembly comprised in the device according to the invention.

As FIGS. 1, 2 and 4 clearly show, the ejector member 9 is thus free to slide within the tubular body 4 of the gripping assembly, said movement having two end stop positions defined by the engagement of the transverse pin 11 against the two opposite ends of the pair of longitudinal slits 12 engaged by the pin 11.

Again with reference to the drawings, in a normal static condition of the device the ejector member 9 is kept by gravity in its lower end stop position, closer to the end mouth 6 of the gripping assembly 3.

When a cap is picked up, the gripping member 3 is lowered onto it, so it penetrates in the seat 5 of the gripping member, making the ejector member 9 move rearwards to the position shown in FIG. 1. The relative position between tubular body 4 and ejector member 9 does not change during the phase in which the cap is screwed onto the bottle. Once the screwing operation is completed, when the screwing head 1 rises again, the upwards displacement of the ejector member 9 is limited by the presence of stop members that come in contact with a circumferential flange 10*a* of the ring 10 integral with the ejector member 9. Said stop means can be defined for example by a pair of walls 13, 14 (see FIGS. 1-3) situated circumferentially along the trajectory T of the carrousel (FIG. 3) immediately upstream, with reference to the direction of the movement, relative to the area P where a new cap is to be picked up. As illustrated in FIG. 2, after the ring 10 comes in contact with the stop walls 13, 14, the further rise of the screwing head 1 causes a relative upwards displacement of the tubular body 4 with respect to the ejector member 9 or, which is the same, a relative downwards movement of the ejector member 9 with respect to the tubular body 4. The ejector member 9 thus moves in the direction of the mouth 6 of the gripping assembly 3 causing the ejection of the cap C, if said cap has not been screwed onto the bottle and therefore needs to be ejected from the gripping assembly. Naturally, the arrest against the walls 13,14 takes place only if a cap C has remained in the gripping member 3. In the case of correct operation, instead, after the cap has been applied onto the bottle the movable equipment constituted by the ejector member 9 and by the walls 10, 11 connected thereto falls by gravity in its lower end stop position.

With reference to the specific embodiment illustrated herein, the transverse pin 1 engages opposite holes 10*b* of the ring 10 (FIG. 5), a through transverse hole 9*a* obtained in the bottom wall of the cup-shaped ejector member 9, and is held in position by means of a screw 20 (FIG. 2) which engages a hole obtained starting from the bottom surface of the cup-shaped member 8. In FIG. 5, the balls 7 are not shown, for the sake of simplicity.

Obviously, the conformation of the ejector member 9 can be wholly different from the one illustrated by way of example herein, and different can be the conformation and arrangement of the part or of the element positioned outside the tubular body 4 which is rigidly connected to the internal ejector member 9 and which co-operates with the stop means to limit the upwards travel of the ejector member 9 during the rise of the head if a cap has remained in the gripping member 3 after an attempted application onto a bottle.

It is readily apparent that, thanks to the characteristics set out above, the structure of the ejector member is extremely simplified, since it is constituted by an element that is freely slidable within the tubular body of the gripping assembly. The machine whereon the device is mounted, moreover, benefits from a considerable simplification, since it need not be provided with any type of command, be it mechanical or electrical, of the axial movement of the ejector member. Lastly, the device is also better than prior art devices from the viewpoint of safety and hygiene, because it has no sliding parts that continually move between the lower area of the machine, usually held in sterile atmosphere, and the upper area of the machine, where the mechanical members with their lubrications are typically housed.

Naturally, without altering the principle of the invention, the construction details and the embodiments may vary widely from what is described and illustrated purely by way of example herein, without thereby departing from the scope of the present invention.

What is claimed is:

1. A capping machine, comprising:

a fixed structure and at least one capping device for applying a cap on the neck of a bottle or similar container, wherein said at least one capping device comprises:

a cap applying head movable along an axis, and a gripping unit removably connected to a lower end of the applying head and having a tubular body with an end mouth which is adapted to receive and hold a cap therewithin, said gripping unit comprising an ejecting member which is freely slidably mounted within the tubular body of the gripping unit along said axis, said ejecting member being totally separate and independent from said head, wherein said machine further comprises stop means connected to said fixed structure, said stop means being independent and separate from said gripping unit and said cap applying head and being located outside of said gripping unit and said cap applying head in a position in which they are able to limit the upward displacement of said ejecting member when the tubular body of the gripping unit moves upwards along with the applying head after the application of the cap on the bottle, so that the ejecting member is moved downwardly with respect to said tubular body of the gripping unit during said upward displacement, and so that, in the event the cap remains in the end mouth due to a failure in an operation for applying the cap on a bottle or container, the cap is ejected from the end mouth by said ejecting member.

2. A machine as claimed in claim 1, comprising a carrousel structure carrying said at least one capping device, said carousel structure being rotatable around a main axis parallel to said axis of movement of the cap applying head of said at least one capping device, so that the cap applying head can perform an operation for applying the cap on a bottle or container while it is caused to rotate around said main axis from an area where a new cap is to be picked up, said stop means comprising at least one fixed wall which extends circumferentially along and adjacent the trajectory of the carrousel, in an area where the cap applying head is moved upwardly, upstream of an area where a new cap is to be picked up.

3. A machine as claimed in claim 1, wherein said gripping unit includes an auxiliary element rigidly connected to the ejecting member and positioned outside said tubular body, said auxiliary element being apt to come in contact with said stop means during said upward movement of the applying head after the application of the cap on the bottle.

4. A machine as claimed in claim 3, wherein said auxiliary element is rigidly connected to the ejecting member by means of a transverse pin which engages opposite longitudinal slits formed in the wall of the tubular body of the gripping unit.

5. A machine as claimed in claim 3, wherein said element is ring shaped, with a stop surface able to co-operate with said fixed wall.

6. A machine as claimed in claim 1, wherein said ejecting member has a cup-shaped cylindrical body.

7. A machine as claimed in claim 6, wherein said tubular body has a circumferential series of longitudinal slits, two diametrically opposite slits comprised in said series being engaged by said transverse pin.

8. A machine as claimed in claim 7, wherein said longitudinal slits are obtained in an intermediate portion with reduced diameter of the tubular body of the gripping unit.

* * * * *